United States Patent [19]

Nakahara et al.

[11] Patent Number: 4,864,367

[45] Date of Patent: Sep. 5, 1989

[54] IMAGE TRANSFERRING DEVICE FOR A COPIER

[75] Inventors: Tosio Nakahara; Nobuo Kasahara, both of Yokohama, Japan

[73] Assignee: Ricoh Company, Ltd., Tokyo, Japan

[21] Appl. No.: 185,684

[22] Filed: Apr. 22, 1988

[30] Foreign Application Priority Data

Jun. 22, 1987 [JP] Japan ..... 62-95660

[51] Int. Cl.[4] ..... G03G 15/00

[52] U.S. Cl. ..... 355/272; 355/274

[58] Field of Search ..... 355/3 TR, 14 TR, 3 DR; 430/48, 126

[56] References Cited

U.S. PATENT DOCUMENTS 4,277,162 7/1981 Kasahara et al. ..... 355/3 TR X
4,415,256 11/1983 Inoue et al. ..... 355/3 TR

FOREIGN PATENT DOCUMENTS 0164370 12/1981 Japan ..... 355/3 TR
0164371 12/1981 Japan ..... 355/3 TR
0050564 3/1983 Japan ..... 355/3 DR
0101682 6/1984 Japan ..... 355/3 TR

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A device applicable to a color copier or the like for transferring an image to a paper sheet which includes a hollow drumlike frame the peripheral wall of which is removed except for opposite circumferential edge portions and a connecting portion which links the edge portions to each other. A conductive sheet is wrapped around the frame to cover the removed portion of the frame. An intermediate portion of the conductive sheet is bulged radially outward beyond the outer periphery of the frame.

10 Claims, 2 Drawing Sheets

IMAGE TRANSFERRING DEVICE FOR A COPIER

FIELD OF THE INVENTION

The present invention relates to a device installed in a copier or like image forming equipment for transferring a toner image and, more particularly, to an image transferring device of the type using a transfer drum around which a conductive sheet is wrapped in a generally cylindrical configuration.

BACKGROUND OF THE INVENTION

An image transferring device applicable to an electrophotographic copier or the like may be constructed as shown and described in any of Japanese Laid-Open Patent Publication (Kokai) Nos. 54-19451, 56-120546, and 56-57069 by way of example. A device disclosed in these Laid-Open Publications includes a hollow cylindrical transfer drum, a conductive sheet wrapped around the transfer drum, and a transfer charger accommodated in the hollow transfer drum. Specifically, the transfer drum is constituted by opposite circumferential edge portions and an axially extending portion which links the edge portions to each other, the other portion being removed. Wrapped around such a transfer drum, the conductive sheet entirely covers the removed portion of the drum and is made of Mylar or like material. The transfer charger is adapted to transfer a toner image from a photoconductive drum which adjoins the transfer drum to a paper sheet which is supported and guided by the conductive sheet.

A problem with the above-described type of prior art image transferring device is that, since the conductive sheet for supporting and guiding a paper sheet is relatively thin and flexible, it is caused to yield into the transfer drum when tension is applied to the paper sheet due to sliding resistance while the paper sheet is transported between the transfer drum and the photoconductive drum, narrow guide plates, and others. When the conductive sheet is cased to yield as stated, a toner image practically fails to be transferred in a central area of the paper sheet or is dislocated there. Especially, in the case that such a device is applied to a color copier which effects multiple image transfer, color components which constitute a single image in combination are brought out of register with each other resulting in an unattractive copy. This is because the current applied to the transfer charger differs from one color component to another, and, therefore, the coulomb force of the conductive sheet which electrostatically attracts a paper sheet differs each time, causing the position of a paper sheet to vary transfer by transfer (color by color) in the area where the conductive sheet yields.

OBJECTS OF THE INVENTION

It is therefore an object of the present invention to provide an image transferring device for a copier or like image forming equipment which prevents a toner image from being omitted or dislocated in a central part of a paper sheet.

It is another object of the present invention to provide a generally improved image transferring device for a copier or like image forming equipment.

SUMMARY OF THE INVENTION

A device installed in image forming equipment for transferring an image to a paper sheet of the present invention comprises a drum-like frame comprising opposite circumferential edge portions which define opposite end portions of a hollow cylinder, a connecting portion connecting the edge portions to each other, and a removed portion formed by removing a wall of the hollow cylinder except for the edge portions and connecting portion. A conductive sheet is wrapped around a peripheral portion of the frame in such a manner as to fully cover the removed portion and with only a leading side thereof fixed to the connecting portion of the frame. The conductive sheet has an intermediate portion which is bulged radially outward beyond the outer periphery of the frame.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
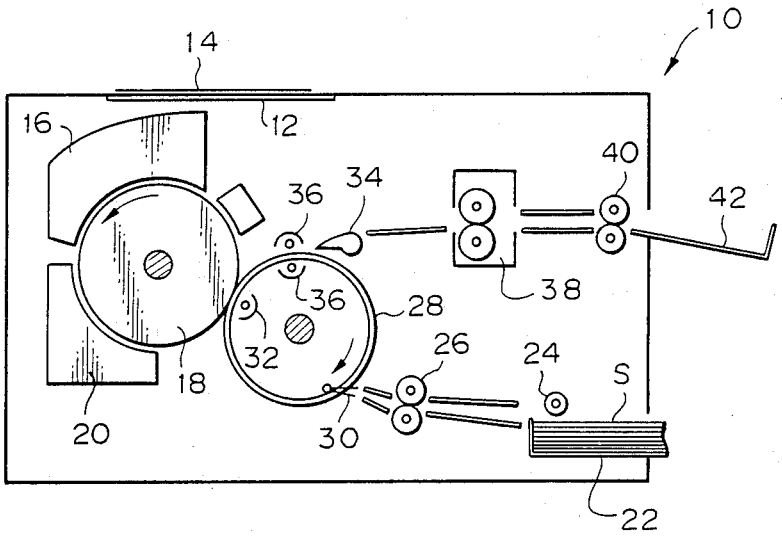
FIG. 1 is a schematic view of a copier to which the present invention is applicable.

Referring to FIG. 1 of the drawings, a color copier to which the present invention is applicable is shown and generally designated by the reference numeral 10. It is to be noted that the color copier 10 is of the kind shown and described in Laid-Open Publication No. 56-120546. As shown, the copier 10 includes a glass platen 12 on which an original document 14 to copy is laid. While optics 16 illuminate the document 14, a photoconductive drum 18 is exposed imagewise in a manner well known in the art. A latent image electrostatically formed on the drum 18 by such exposure is developed by a developing device 20 to become a toner image. A paper sheet S is fed from a sheet cassette 22 toward a transfer drum 28 by a feed roller 24 and a register roller 26. An openable sheet gripper 30 which is provided on and along the axis of the transfer drum 28 grips the leading edge of the paper sheet S in cooperation with the transfer drum 28. Thus, the paper sheet S is wrapped around the drum 28. At the instant when the leading edge of the paper sheet S is brought into register with the leading edge of that area of the photoconductive drum 18 in which the toner image is provided, a transfer charger 32 is energized to transfer the tone image from the photoconductive drum 18 to the paper sheet S.

The color copier 10 is of the type forming the same number of tone images on the photoconductive drum 18 as the color components which are optically separated from the document 14. Hence, the transfer drum 28 is rotated by the same number of rotations as the separated color components so as to sequentially transfer toner images of such different colors to a single paper sheet S. After all the toner images of different colors have been transferred to the paper sheet S, the sheet gripper 30 is opened when it is brought close to a separator pawl 34 while, at the same time, a separator charger 36 is activated. As a result, the leading edge portion of the paper sheet S is separated from the surface of the transfer drum 28 to run onto the separator pawl 34. Fully separated from the transfer drum 28 by the separator pawl 34, the paper sheet S is routed through a fixing device 38, a discharge roller 40 and others to a tray 42 which is adapted to receive copies.

Figure 2:
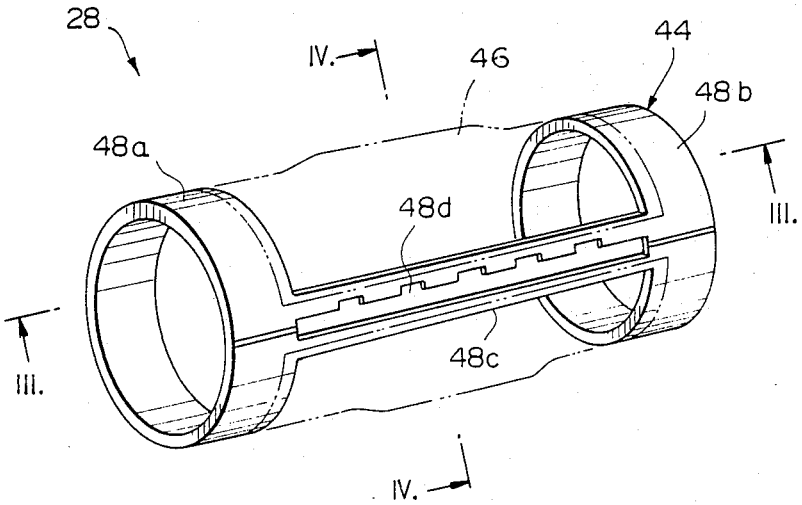
FIG. 2 is a perspective view showing a specific configuration of a transfer drum which is included in an image transferring device in accordance with the present invention.

FIG. 2 shows a specific structure of the transfer drum 28. In the figure, the transfer drum 28 includes a hollow drum-like frame 44 and a conductive sheet 46. Made of resin, for example, the frame 44 has opposite circumferential edge portions 48*a* and 48*b*, and an elongate connecting portion 48*c* which extends substantially parallel to the axis of the transfer drum 28 to join the edge portions 48*a* and 48*b* to each other and which constitutes a part of the periphery of the drum 28. The frame 44, therefore, appears to be a hollow cylinder a hollow part of which is removed except for the opposite edge portions 48*a* and 48*b* and the connecting portion 48*c*. The removed portion of the frame 44 is dimensioned slightly greater than a paper sheet S having the largest size which is applicable to the copier 10. The conductive sheet 46 is dimensioned slightly greater than the removed portion of the frame 44 and is wrapped around the frame 44 from one side of the connecting portion 48*c* to the other side covering the removed portion of the frame 44. The connecting portion 48*c* is provided with a recess 48*d* which extends in the lengthwise direction of the frame 44 for receiving mounting of the sheet gripper 30.

Figure 3:
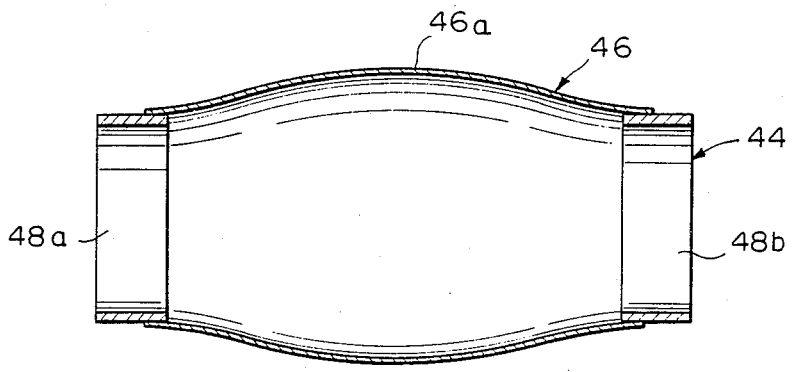
FIG. 3 is a section along line III—III of FIG. 2.
Figure 4:
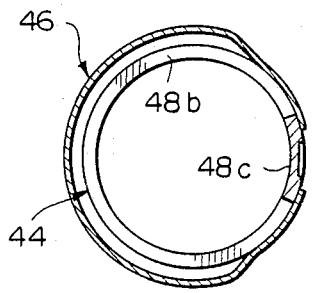
FIG. 4 is a section along line IV—IV of FIG. 2.
Figure 5:
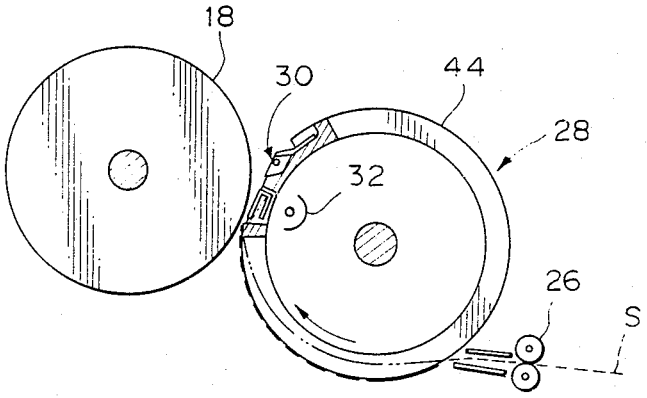
FIG. 5 is a schematic view demonstrating the operation of the image transferring device of the present invention.

Referring to FIGS. 3 and 4, a specific configuration of the conductive sheet 46 is shown. As shown, the conductive sheet 46 has an intermediate portion 46*a* which is bulged radially outward beyond the outer periphery of the frame 44. Hence, when the paper sheet S is strained causing a tension acting thereon to urge the intermediate portion 46*a* of the sheet 46 radially inward as shown in FIG. 5, the tension is absorbed by the bulge of the intermediate portion 46*a*. It follows that the paper sheet S is prevented from yielding into the transfer drum 28 as indicated by a dash-and-dots line in FIG. 5.

It is noteworthy that, in the position where the transfer drum 28 makes contact with the photoconductive drum 18, the bulge of the sheet intermediate portion 46*a* is deformed along the back of the paper sheet S in such a manner as to press the sheet S against the photoconductive drum 18. Therefore, the bulge does not affect the transport of the sheet S and the transfer of toner images at all.

In summary, it will be seen that the present invention provides an image transferring device which transfers a toner image in a desirable manner by preventing it from being partly omitted or from being dislocated in a central area of a paper sheet.

Various modifications will become possible for those skilled in the art after receiving the teachings of the present disclosure without departing from the scope thereof.

What is claimed is:

1. A device installed in image forming equipment for transferring an image to a paper sheet, said device comprising:

(a) a drum-like frame comprising opposite circumferential edge portions which define opposite end portions of a hollow cylinder, a connecting portion connecting said edge portions to each other, and a removed portion formed by removing a wall of said hollow cylinder except for said edge portions and said connecting portion;

(b) a cover sheet wrapped around a peripheral portion of said frame in such a manner as to fully cover said removed portion and with only a leading side thereof fixed to said connecting portion of said frame, said cover sheet having an intermediate portion which is bulged radially outwardly beyond the outer periphery of said frame; and (c) a transfer charger disposed in said drum-like frame, whereby, when a paper sheet wrapped around said cover sheet is strained, causing a tension acting thereon to urge said intermediate portion radially inwardly, the tension is absorbed by the bulge of said intermediate portion.

2. A device as claimed in claim 1, wherein said removed portion of said frame is dimensioned greater than a paper sheet having the largest size which is applicable to the image forming apparatus.

3. A device as claimed in claim 1, wherein said cover sheet is dimensioned greater than said removed portion of said frame.

4. A device as claimed in claim 1, wherein said frame is provided with a recess which extends in a lengthwise direction of said frame.

5. A device as claimed in claim 1, wherein said cover sheet is conductive.

6. Image forming equipment for transferring an image to a paper sheet, said image forming equipment comprising:

(a) a photoconductive drum;

(b) a developing device operatively associated with said photoconductive drum; and (c) a transfer drum operatively associated with said photoconductive drum, said transfer drum comprising:

(i) a drum-like frame comprising opposite circumferential edge portions which define opposite end portions of a hollow cylinder, a connecting portion connecting said edge portions to each other, and a removed portion formed by removing a wall of said hollow cylinder except for said edge portions and said connecting portion;

(ii) a cover sheet wrapped around a peripheral portion of said frame in such a manner as to fully cover said removed portion and with only a leading side thereof fixed to said connecting portion of said frame, said cover sheet having an intermediate portion which is bulged radially outwardly beyond the outer periphery of said frame; and (iii) a transfer charger disposed in said drum-like frame, whereby, when a paper sheet wrapped around said cover sheet is strained, causing a tension acting thereon to urge said intermediate portion radially inwardly, the tension is absorbed by the bulge of said intermediate portion.

7. Image forming equipment as claimed in claim 6, wherein said removed portion of said frame is dimensioned greater than a paper sheet having the largest size which is applicable to the image forming apparatus.

8. Image forming equipment as claimed in claim 6, wherein said cover sheet is dimensioned greater than said removed portion of said frame.

9. Image forming equipment as claimed in claim 6, wherein said frame is provided with a recess which extends in a lengthwise direction of said frame.

10. Image forming equipment as claimed in claim 6, wherein said cover sheet is conductive.

* * * * *